US005880387A

United States Patent [19]

Kim et al.

[11] Patent Number: 5,880,387

[45] **Date of Patent: *Mar. 9, 1999**

[54] DIGITAL SOUND PROCESSOR HAVING A SLOT ASSIGNER

[75] Inventors: Sang Yong Kim; Hag Keun Kim, both of Kyungki-Do, Rep. of Korea

[73] Assignee: LG Semicon Co., Ltd., Cheongju, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 775,293

[22] Filed: Dec. 31, 1996

[30] Foreign Application Priority Data

Dec. 31, 1995 [KR] Rep. of Korea ..... 1995/70169

[51] Int. Cl.[6] ..... G10H 1/46; G10H 7/00

[52] U.S. Cl. ..... 84/604; 84/633

[58] Field of Search ..... 84/633, 665, 601–607

[56] References Cited

U.S. PATENT DOCUMENTS

| | | | |
|---|---|---|---|
| 4,622,877 | 11/1986 | Strong | 84/604 |
| 4,785,707 | 11/1988 | Suzuki | 84/605 |
| 4,805,509 | 2/1989 | Matsuda | 84/604 |
| 5,227,573 | 7/1993 | Nakano | 84/633 X |
| 5,229,535 | 7/1993 | Kozuki et al. . | |
| 5,264,657 | 11/1993 | Takauji . | |
| 5,270,477 | 12/1993 | Kawashima | 84/633 X |
| 5,345,036 | 9/1994 | Kondo | 84/633 |
| 5,442,126 | 8/1995 | Tokiharu | 84/603 |

*Primary Examiner*—Stanley J. Witkowski

[57] ABSTRACT

A digital sound generating apparatus and sound generating method therefor is disclosed including a CPU interface for exchanging information with a CPU controlling the generation of a sound, a slot memory for storing various control parameters of the sound to be generated, a slot assigner for providing slot information for generating a new sound to the CPU when the new sound is generated, a data processor for executing an operation to reproduce an original sound using the various parameters of the slot memory, and a volume controller for receiving the information of the slot memory and the slot assigner to control the volume of the original sound.

14 Claims, 7 Drawing Sheets

FIG.2C
CONVENTIONAL ART
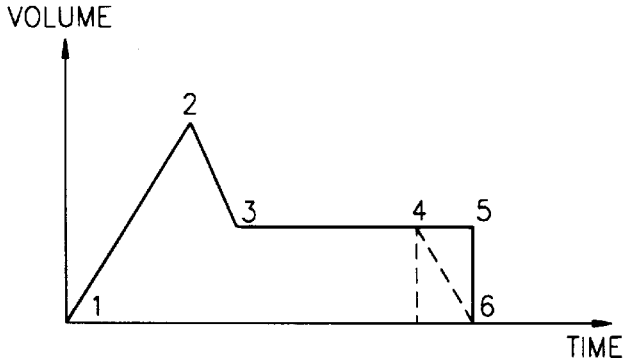
FIG.2D
CONVENTIONAL ART
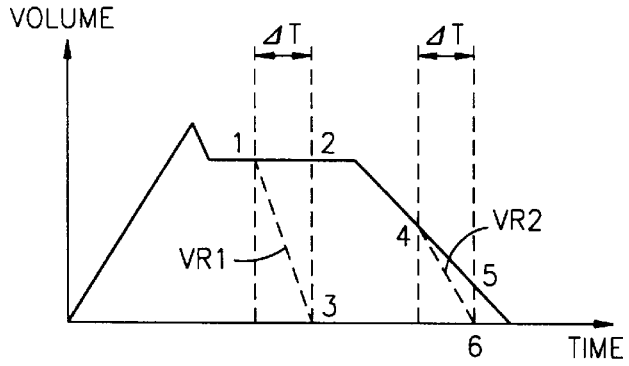
FIG. 3
CONVENTIONAL ART
| SLOT (0) PARAMETER AREA | SLOT (1) PARAMETER AREA | . . . | . . . | SLOT (30) PARAMETER AREA | SLOT (31) PARAMETER AREA |
|---|---|---|---|---|---|
| SAMPLE ADDRESS<br>PITCH CONTROL<br>FILTER CONTROL<br>.<br>.<br>. | | | | | |

DIGITAL SOUND PROCESSOR HAVING A SLOT ASSIGNER

BACKGROUND OF THE INVENTION

The present invention relates to a sound generating apparatus, and more particularly to a digital sound generating apparatus and sound generating method therefor which is capable of improving availability of a central processing unit (CPU) and improving performance effects by assigning the most appropriate slot through a slot assigner rather than the CPU and providing information on slot assignment to the CPU.

A conventional sound generating apparatus includes, as shown in FIG. 1, a slot memory 2 for storing various sound control parameters, a CPU interface 1 for exchanging information with the slot memory 2 and a CPU, a data processor 3 for executing an operation to reproduce an original sound using the various control parameters of the slot memory 2, and a volume controller 4 for receiving the information of the slot memory 2 and the data processor 3 to control the volume of the original sound.

In a general digital sound processor, a volume envelope indicating temporal variations in the volume has ADSR (attack, decay, sustain and release) forms. For example, when a key on a musical keyboard is turned On by pressing it, the conventional sound generating apparatus of FIG. 1 continues to generate a sound at a sustain level S after passing through an attack level A and a decay level D, as shown in FIG. 2A. Once the key is OFF, the sound is attenuated at a release level R according to a release value. In another case, when the key is ON, the sound is gradually attenuated with the lapse of time, as shown in FIG. 2B.

In operation, if a message indicating that the key is an ON state is received, the CPU writes in the slot memory 2 a start volume level (1), a final volume level (2), and a temporal volume variation between the start and final volume levels, i.e. a volume rate as shown in FIGS 2A and 2B, in order to achieve the desired attack interval A. The volume rate of an interval (1)–(2)' is larger than that of (1)–(2), and the interval (2)'–(3) is smaller than that of (2)–(3).

The volume rate has a positive number only at a start (or attack) interval and has a negative number or a zero value at other intervals. Although information related to the written start volume is not shown in the drawings, the volume rate is added to a current volume of every frame by an envelope generator and the current volume continues to increase until it reaches a target volume level.

If the current volume level reaches the target volume level, the attack interval is completed, and the current volume level is as indicated by (2). Then, the CPU writes a new target volume level (3) and a new volume rate in the slot memory 2 in the same way as in the attack operation. Similar operations are carried out for the sustain and release intervals.

When various sounds are generated at the same time, in particular, when all slots which are capable of generating a sound generate sounds simultaneously, if a new sound to be performed is received, the CPU searches for a slot having the lowest volume level by comparing volume information of all the slots and then inserts a parameter for the new sound in that slot. Assuming that the number of sounds which is capable of being simultaneously processed is 32 and a sampling rate is 44.1 KHz, 32 sounds are sequentially processed during one frame of 22.6 $\mu$s, as shown in FIG. 4. Each sound is processed in the unit of a slot and parameters for processing each sound are written in the slot memory by the CPU. The information written in the slot memory to generate one sound, includes a sample address which is an address of a sound sample memory for storing a sound to be performed in a corresponding slot, pitch control for designating the amplitude of a sound, filter control for adjusting timbre, volume control for controlling a temporal variation in the volume, and the like, as shown in FIG. 3. During one frame shown in FIG. 4, slots from slot (0) to slot (31) are sequentially processed.

If it is desired to simultaneously process an A instrument sound at a first slot, a B instrument sound at a second slot and a C instrument sound at a third slot, parameters of the A, B and C instrument sounds are sequentially written in slot (0), slot (1) and slot (2) parameter areas, respectively, through the CPU interface 1. A slot operation mask bit (SOMB) is set to 1 in slot (3) to the last slot parameter area so that no information is written in those slots.

If the parameters for all the slots are received, the data processor 3 and the volume controller 4 shown in FIG. 1 reproduce an original sound from the first slot. The reproduced sound is stored in an internal accumulator (not shown) of the volume controller 4. Thereafter, the second and third slots are sequentially processed and their sounds are sequentially added to the sound stored in the accumulator. Since other slots are not operated, there are no further changes in the accumulator.

If one frame is all processed, data in the accumulator is transmitted to a speaker through a digital-to-analog converter. Since the data processed during one frame is one sampling data out of a number of sampling data of a sound sampled at a constant time interval, a plurality of frames corresponding to the number of sampling data of a corresponding sound should be processed in order to completely process one sound. Further, since each sound differs in length and amplitude, the above A, B and C sounds are completed late if the sampling data is long if the sound is and strong. If 32 sounds are to be simultaneously made, an accurate decision should be made as to what sound should be completed first. If it is necessary to perform a new sound under the state that 32 sounds are not completed, a parameter for the new sound should be inserted in the least important slot in a sound to prevent unnatural performance.

However, since the above sound generating apparatus considers only the volume level received in each slot or only processes the first performance start slot, an important sound to be performed may be wrongly processes, which leads to deterioration in performance effects. Furthermore, since the CPU should take part in volume control information processing of each slot memory whenever a slot is assigned, the processing speed of the sound generating apparatus is delayed when there are many sounds to be generated. To improve this disadvantage, a CPU with a faster processing speed maybe used, but such products are expensive.

SUMMARY OF THE INVENTION

It is therefore an object of the invention to provide a digital sound generating apparatus for reducing slot assign time and improving performance effects by accurately assigning slots.

It is another object of the invention to provide a control method for effectively controlling the digital sound generating apparatus.

In accordance with one aspect of the invention, a digital sound generating apparatus includes a CPU interface for exchanging information with a CPU controlling the generation of a sound, a slot memory for storing various control parameters of the sound to be generated, a slot assigner for providing slot information for generating a new sound to the CPU when the new sound is generated, a data processor for executing an operation to reproduce an original sound using the various parameters of the slot memory, and a volume controller for receiving the information of the slot memory and the slot assigner to control the volume of the original sound.

In accordance with another aspect of the invention, a method for generating a sound of a digital sound generating apparatus includes the steps of: initializing all parameters for each slot; assigning a corresponding slot for each sound; detecting a slot having the volume of "0" after all slots are assigned, and recording its slot number which is to be assigned during a new sound performance; and if there is no slot having the volume of "0", detecting a slot having the lowest volume level by comparing slots which do not have a percussion sound, and recording its slot number which is to be assigned during a new sound performance.

BRIEF DESCRIPTION OF THE ATTACHED DRAWINGS

The advantages and features of the present invention will be more apparent from the detailed description hereunder, with reference to the attached drawings, in which:

FIGS. 2A and 2B are graphs showing a variation in the volume versus time during the generation of a sound of the conventional digital sound generating apparatus, while FIG. 2C is a graph showing a variation in the volume versus time during the generation of a sound according to the conventional art and FIG. 2D shows that of the present invention.

FIG. 3 shows a slot memory structure of the conventional digital sound generating apparatus;

DETAILED DESCRIPTION OF PREFERRED EMBODIMENT

Figure 5:
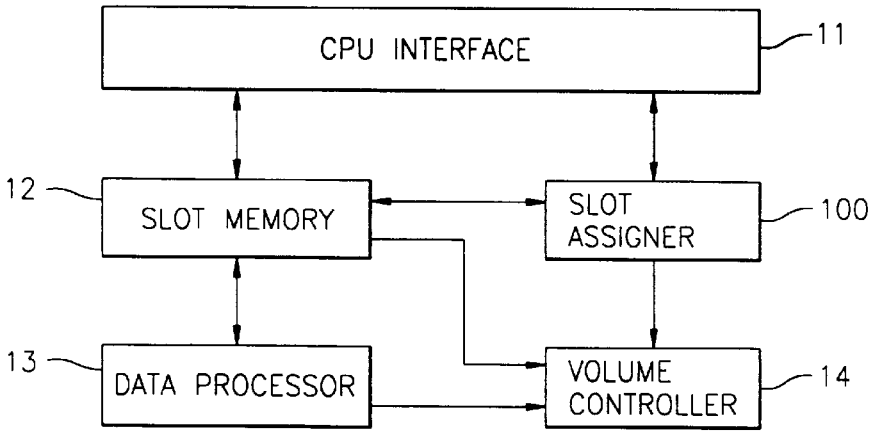
FIG. 5 is a block diagram of a digital sound generating apparatus according to the present invention.

Referring to FIG. 5, a CPU interface 11 exchanges information with a slot memory 12, a slot assigner 100 and a CPU (not shown). The slot memory 12 stores various sound control parameters. The slot assigner 100 provides slot information for generating a sound to the CPU. A data processor 13 reproduces an original sound using the various parameters from the slot memory 12. A volume controller 14 receives the information of the slot memory 12, the data processor 13 and the slot assigner 100 to control the volume of the original sound.

Figure 6:
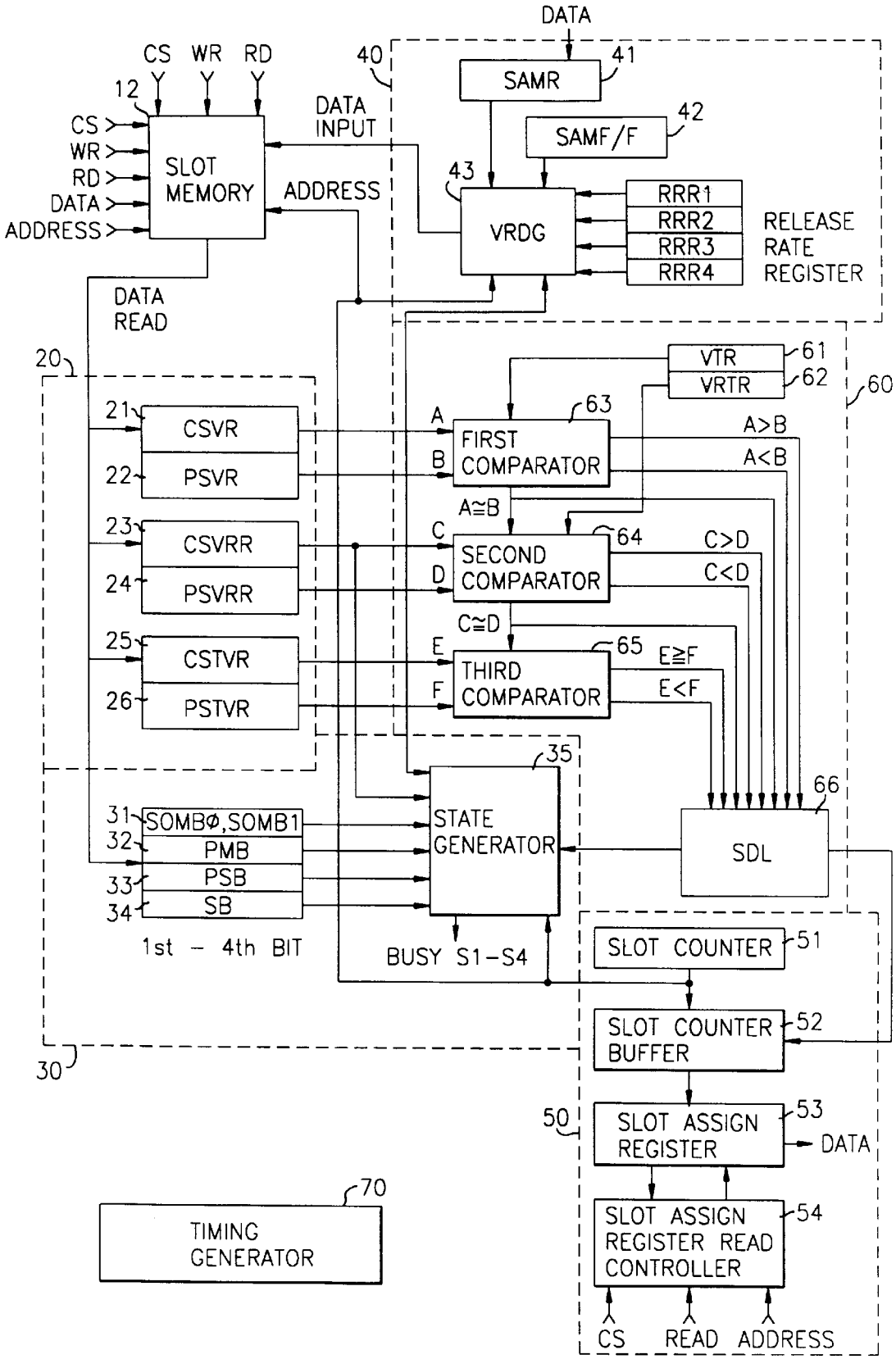
FIG. 6 is a detailed block diagram of a slot assigner shown in FIG. 5.

Referring to FIG. 6, the slot assigner 100 has a slot volume registor 20 for storing volume, volume rate and target volume data for a current sound and a previous sound, a slot volume comparator 60 for comparing the outputs of the slot volume register 20, a slot assign controller 50 for determining a slot number so that the CPU generates a new sound according to the comparative result of the slot volume comparator 60, a slot releasor 40 for preventing the sound from being abruptly stopped by releasing the sound of a corresponding slot which is being produced when the slot number of the slot assign controller 50 is read by the CPU, a state controller 30 for determining a slot state according to the outputs of the slot volume register 20, the slot volume comparator 60 and the slot assign controller 50, and a timing generator 70 for generating an operating control signal. For the purposes of clarity, it should be noted that the connections between the timing generator 70 and the other components of the slot assignor 100 have not been shown.

In operation, the slot memory 12 stores operation parameters needed to generate each sound. Slot operation mask bits (SOMB0and SOM1) for determining whether a corresponding slot is operated, a percussion sound bit (PSB), a sound assign mask bit (SAMB), a percussion sound mask bit (PMB), a skip bit (SB), etc. are additionally stored in the slot memory 12 as well as address information, pitch control information, filter control information, volume control information, etc. The slot memory 12 is divided into a slot units and has slot areas slot (0) -slot (n−1) corresponding to a number n of simultaneous sounds.

Figure 4:
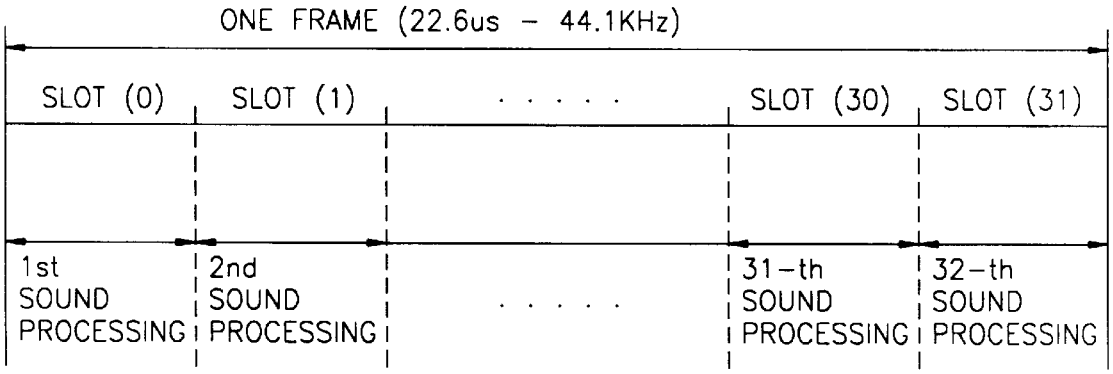
FIG. 4 CONVENTIONAL ART
FIG. 4 shows the relationship between a frame and a slot for sound processing according to the present invention.

The parameter stored in each slot area is read to process data at each corresponding slot processing time as shown in FIG. 4 and used to reproduce an original sound. If the slot operation mask bits of a corresponding slot are "1", that is, if SOMB0=SOM1=1 the corresponding slot is masked and not operated. That is, the slot is said to be idle because the sound processor does not perform sound generation using this slot. If the slot operation mask bits are "0", that is, SOMB0=SOMB1=0, the corresponding slot implements a normal operation. When new data is to be written into a corresponding slot of the slot memory, the slot operation mask bits are operated by the CPU so that SOMB0 is set to 0 and SOMB1 is set to 1. Thus, new data is written while the corresponding slot remains in the idle state, and sound is not generated when writing is taking place. When the writing operation is complete, the CPU sets SOMB0=0 and SOMB1=0 so the corresponding slot begins normal operations.

The slot volume register 20 includes a current slot volume register (CSVR) 21, a previous slot volume register (PSVR) 22, a current slot volume rate register (CSVRR) 23, a previous slot volume rate register (PSVRR) 24, a current slot target volume register (CSTVR) 25 and a previous slot target volume register (PSTVR) 26.

A current volume level value of the slot memory 12 is read and stored in the current slot volume register (CSVR) 21 and is used to compare a current volume level difference between one slot and another slot.

If the first frame is started and the first slot (0) is executed, the current volume of slot (0) stored in the current slot volume register (CSVR) 21, is also loaded into the previous slot volume register (PSVR) 22. Thereafter, If slot (1) is executed, the current volume level (that is, a corresponding slot volume level at a current frame) of slot (1) is loaded into the current slot volume register (CSVR) 21 and the previous slot volume register (PSVR) 22 is maintained at the volume level of slot (0).

The volume levels of slot (0) and slot (1) are compared by a first comparator 63. In other words, the current slot volume register (CSVR) value is compared with the previous slot volume register (PSVR) value.

A current volume rate is read and stored in the current slot volume rate register (CSVRR) 23 during slot execution and the same operation as in the current slot volume register (CSVR) 21 is performed. The previous slot volume rate register (PSVRR) 24 is used for the same operation as in the previous slot volume register (PSVR) 22 for the volume rate of each slot. A target volume level during slot execution is read and stored in the current slot target volume register (CSTVR) 25. The previous slot target volume register (PSTVR) 26 is used for the same operation as in the previous slot volume register (PSVR) 22 for the target volume level. Thus, the slot volume register 20 is used to store the volume, volume rate and target volume data for current and previous sounds.

Meanwhile, the slot volume comparator 60 has first to third comparators 63–65, a slot decision logic (SDL) circuit 66, a volume tolerance register (VTR) 61 and a volume rate tolerance register (VRTR) 62. The first comparator 63 compares the volume values of the current slot volume register (CSVR) 21 and the previous slot volume register (PSVR) 22 for every slot processing interval. The second comparator 64 compares the values of the current slot volume rate register (CSVRR) 23 and the previous slot volume rate register (PSVRR) 24 for every slot processing interval. The third comparator 65 compares the values of the current slot target volume register (CSTVR) 25 and the previous slot target volume register (PSTVR) 26 for every slot processing interval. The slot decision logic (SDL) circuit 66 determines a slot number which is being executed according to the comparative outputs of the first to third comparators 63–65, and stores so as that the slot number in a slot counter buffer 52 of the slot assign controller 50. The volume tolerance register (VTR) 61 provides a tolerance value so as to judge whether the inputs A and B of the first comparator 63 are the same by seeing if there is any difference between the two inputs. The volume rate tolerance register (VRTR) 62 implements the same operation as the volume tolerance register (VTR) 61 for the current slot volume rate register (CSVRR) 23 and the previous slot volume rate register (PSVRR) 24.

Figure 7:
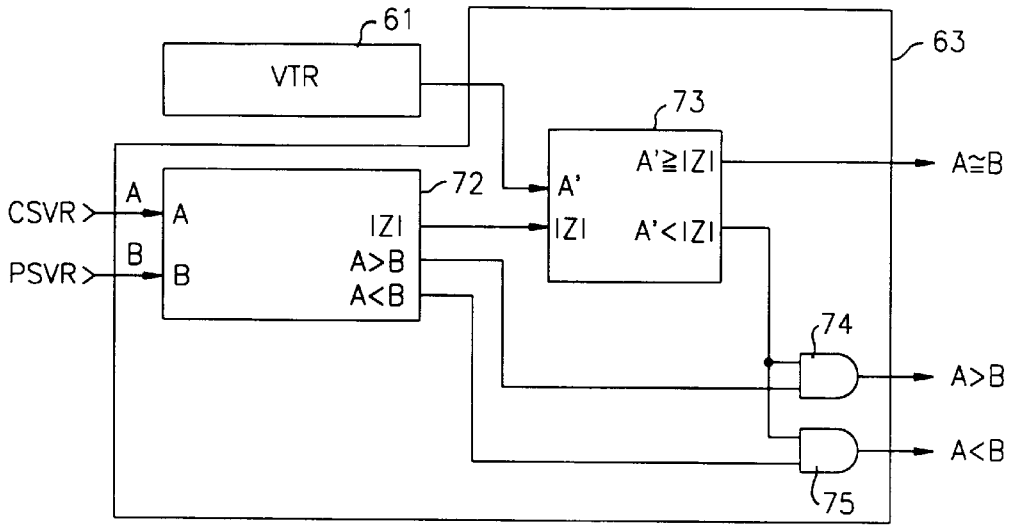
FIG. 7 is a block diagram showing one example of a first comparator of a slot volume comparator shown in FIG. 6.

As shown in FIG. 7, the first comparator 63 includes a subtracter 72, a comparator 73 a first AND gate 74 and a second AND gate 75. The subtracter 72 receives a current slot volume register value A and a previous slot volume register value B and generates three outputs. The subtractor 72 outputs an absolute value $|Z|$ of A>B, a first logic value indicating whether A>B, and a second logic value indicating whether A<B comparator 73 receives a value A' of the volume tolerance register 61 and the absolute value generated by the subtracter 72, and generates a third logic value indicating whether $A' \geqq |Z|$, and a fourth logic value indicating whether $A' < |Z|$. Here, the third logic value indicating that A≅B, is output to SDL 66 and the second comparator 64. The fourth logic value is ANDed with the first and second logic values output by the subtracter 72 by the first and second AND gates 74 and 75, respectively. The first comparator 63 (i.e., the first AND gates 74) outputs a fifth logic value indicating whether A>B. The first comparator 63 (i.e. the second AND gate 75) also outputs a sixth logic value indicating whether A<B to the slot decision logic SDL 66. If the third logic value indicates the volume tolerance register value A' is equal to or greater than the absolute value $|Z|$, it is judged that the current slot volume level is identical to the previous slot volume level.

Figure 8:
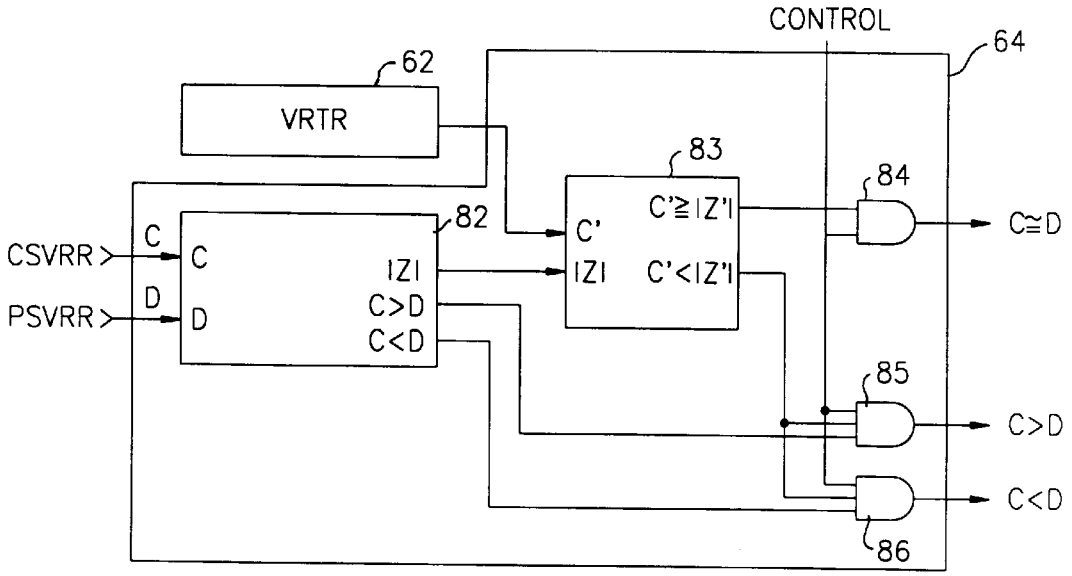
FIG. 8 is a block diagram showing one example of a second comparator of the slot volume comparator shown in FIG. 6.

Referring to FIG. 8, the second comparator 64 shown in FIG. 6 includes a subtracter 82 for receiving a current slot volume rate register value C and a previous slot volume rate register value D, a comparator 83 for receiving an absolute value $|Z'|$ of the difference between two inputs of the subtracter 82 and a value C' of the volume rate tolerance register 62, a third AND gate 84, a fourth AND gate 85 and a fifth AND gate 86. The subtractor 82 outputs the absolute value $|Z'|$ of C minus D, a seventh logic value indicating whether C>D, and an eighth logic value indicating whether C<D. The comparator 83 outputs a ninth logic value indicating whether $C' \geqq |Z'|$ and a tenth logic value indicating, whether $C' < |Z'|$. Here, the ninth logic value is ANDed by the third AND gate 84 in response to a control signal to output an eleventh logic value indicating that C≅D, which is sent to the SDL 66 and the third comparator 65. Meanwhile, the seventh and eight logic values are ANDed with the tenth logic value by the fourth and fifth AND gates 85, 86, respectively, in response to a control signal. As a result, the second comparator 64 outputs a twelfth logic value to the SDL 66 indicating whether C>D, and a thirteenth logic value to the SDL 66 indicating whether C<D.

The third comparator 65 is similar to the first and second comparators 63 and 64, but the current slot target volume register value E is compared with the previous slot target volume register value F without any reference to a tolerance value. As a result, the third comparator 65 outputs a fourteenth logic value to the SDL 66 indicating whether E≧F and a fifteenth logic value to the SDL 66 indicating whether E<F.

Thus, the slot volume comparator 60 determines a slot to be assigned by comparing the current slot volume register value, the current slot volume rate register value and the current slot target volume register value with the previous slot volume register value, the previous slot volume rate register value and the previous slot target volume register value, respectively.

The slot releasor 40 has a slot assign mask register (SAMR) 41 for appropriately adjusting a volume rate of a corresponding slot at the next frame from which the CPU reads a value of a slot assign register 53, a slot assign mask flip-flop (SAMF/F) 42 for judging whether the corresponding slot performs a release operation together with the value of the slot assign mask register (SAMR) 41, a volume release data generator (VRDG) 43 for designating release rate register values according to the current volume value of the corresponding slot, and release rate registers RRR1–RRR4 for classifying and storing a volume release rate so as to provide the most natural volume attenuation (decrease) according to the volume level of the corresponding slot.

In operation, if the CPU reads the value of the slot assign register 53 of the slot assign controller 50, the value is stored in the slot assign mask register (SAMR) 41. The slot assign mask register (SAMR) 41 is used to appropriately adjust the volume rate of the corresponding slot at the next frame.

Figure 1:
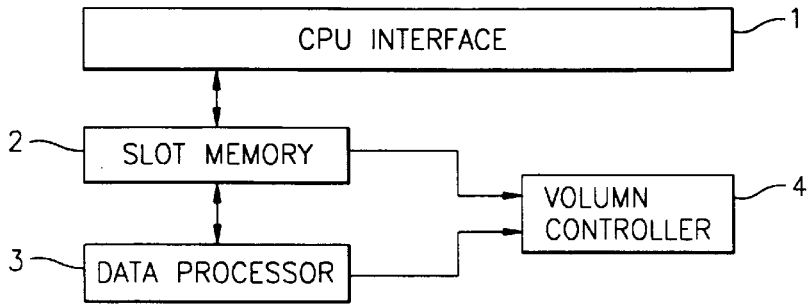
FIG. 1 CONVENTIONAL ART
FIG. 1 is a block diagram of a conventional digital sound generating apparatus.
Figure 2A:
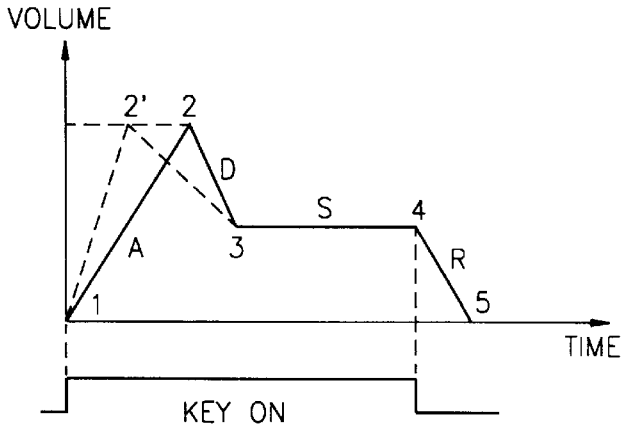
FIG.2A CONVENTIONAL ART
Figure 2B:
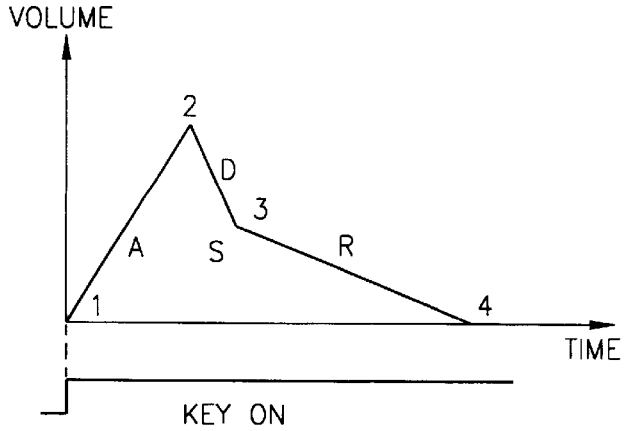
FIG.2B CONVENTIONAL ART

FIG. 2C shows the conventional art wherein the volume level of the sound generated from a slot when new sound data parameters are written therein. The currently generated sound at volume level (5) abruptly drops, instead of a desirable gradual attenuation from (4) to (6).

FIG. 2D shows the gradual volume attenuation according to the present invention. When the sound of the corresponding slot is maintained at a sustain level (1), if the corresponding slot is designated for generating a new sound, the sustain operation is maintained to a volume level (2) during a time ΔT that the CPU reads the value of the slot assign register 53 and prepares to write a new parameter in the corresponding slot. After the CPU prepares ready to write the new parameter in the corresponding slot, i.e. after the slot assign ready time, if the sound at volume level (2), the sound which is being performed is abruptly decreased to volume level (3), unnatural effects such as a suddenly stopped sound occur.

Therefore, if the CPU reads the value of the slot assign register 53, a release rate register value VR1 from one of the release rate registers RRR1, RRR2, RRR3, and RRR4 should be designated so that the volume of the corresponding slot gradually decreases from (1) to (3) as shown in FIG. 2D according to the present invention. Since the slot assign ready time of the CPU is fixed, the volume rate varies with a current volume level value. For example, if the CPU reads the value of the slot assign register 53 at a position (4), a natural sound can be heard by varying the volume rate from (4) to (6). Thus, the volume release rate of the most natural sound can be written by selecting the values of the release rate registers RRR1, RRR2, RRR3 and RRR4 according to the volume level of the corresponding slot when the CPU reads the value of the slot assign register 53.

The volume release data generator (VRDG) 43 selects different volume release rates of the release rate registers RRR1, RRR2, RRR3, and RRR4 according to the volume level when the corresponding slot is designated to generate a new sound, and sets the target volume to zero. For example, as shown in FIG. 2D, if the slot is assigned to generate a new sound during sound generation already in progress, such as at positions (1) or (4), the currently generated sound is quickly reduced at a volume rate of VR1 or VR2 to reach the target volume which is set to zero.

The slot assign mask flip-flop (SAMF/F) 42 sets a slot assign mask flip-flop value of the corresponding slot to "1" when the CPU reads the value of the slot assign register 53 and clears the slot assign mask flip-flop value to "0" when the CPU completes writing a new parameter in the corresponding slot. Thus, if the CPU reads the slot number of the slot assign controller 50, the slot releasor 40 prevents the sound from being abruptly stopped during a performance by releasing the sound of the corresponding slot which is being produced.

The state controller 30 includes a slot operation mask bit (SOMB) register 31 for controlling an operation of the corresponding slot from the slot memory 12, a percussion sound mask bit (PMB) register 32 for operating the corresponding slot irrespective of a percussion sound, a percussion sound bit (PSB) register 33 for indicating whether the corresponding slot is a percussion sound, a skip bit (SB) register 34 for indicating an important percussion sound when all the slots of a corresponding frame are a percussion sound, and a state generator 35 for generating a new state value according to the state of each register. The slot operation mask bits SOMB0 and SOMB1 stored in the SOMB register 31 have been discussed above.

The percussion sound mask bit (PMB) register 32 indicates that a sound is not a percussion sound even though a percussion sound may actually be present.

If a percussion sound bit of the corresponding slot is "1", the percussion sound bit (PSB) register 33 indicates that the corresponding slot performs a percussion sound. Since the percussion sound constitutes a beat, the slot is not assigned even though the current volume level of the percussion instrument sound is smaller than that of another instrument sound, unless all the slots are used for reproducing percussion sounds, in which case the skip bit (SB) register 34 is checked. If a volume level is "0", the slot is cleared to "0" and assigned.

If all the slots of a corresponding frame are percussion sounds, the skip bit (SB) register 34 selects a slot having a percussion sound with the lowest volume level or having a percussion sound of least importance. If a skip bit is "1", the slot is not assigned. Thus, the skip bit register 34 is used to designate a particularly important percussion sound.

The state generator 35 generates state bits S1-S4. S1 is set to "1" when the corresponding slot is a start slot or a percussion slot. S2 is set to "1" when the corresponding slot is not a start slot and a volume value is not "0". S3 is set to "1" when the corresponding slot is not a start slot and the volume value is "0". S4 is set to "1" when the corresponding slot is an idle slot. The state generator 35 generates a busy signal if there is no slot to be assigned in a frame which is being executed according to the outputs of the slot operation mask bit (SOMB) register 31, the percussion sound mask bit (PMB) register 32, the percussion sound bit (PSB) register 33, the skip bit (SB) register 34 and slot volume register 20.

The slot assign controller 50 has a slot counter 51 for generating a slot number which is being executed for every frame execution interval, a slot counter buffer 52 for selectively storing a slot counter value using a control signal from the SDL 66, a slot assign register 53 for simultaneously storing the same data as in the slot counter buffer 52, and a slot assign register read controller 54 for preventing the value of the slot counter buffer 52 from being transferred to the slot assign register 53 when the CPU reads the value of the slot assign register 53, so that the CPU can read stable data.

In operation, the slot counter 51 increases its value by 1 during slot execution and indicates a slot which is being executed. If one frame is over, the slot counter 51 is reset and the counter value becomes "0". The slot counter buffer 52 and the slot assign register 53 store a current slot count number during one-frame execution. When the CPU is not reading the value of the slot assign register 53, the contents of the slot counter buffer 52 are transferred to the slot assign register 53. If the CPU is reading the value of the slot assign register 53, the contents of the slot counter buffer 52 are not transferred to the slot assign register 53.

Figure 9:
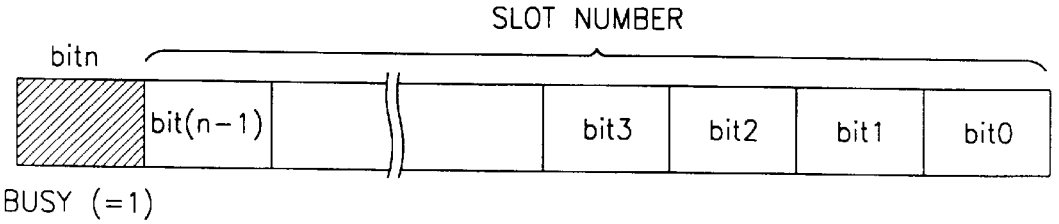
FIG. 9 shows a slot assign register structure of a slot assign controller shown in FIG. 6.

When the state generator 35 generates the busy signal, the most significant bit of the slot counter buffer 52 is set to "1", as shown in FIG. 9, and informs that there is no slot to be assigned in a current frame. If the slot assign register read controller 54 is operating during a one-frame interval when the CPU reads the value of the slot assign register 53 for a slot for generating a new sound then, the value of the slot assign register 53 is read after slot (31) is processed and a frame end signal is generated so as not to read an inaccurate slot number during a frame.

Figure 10A:
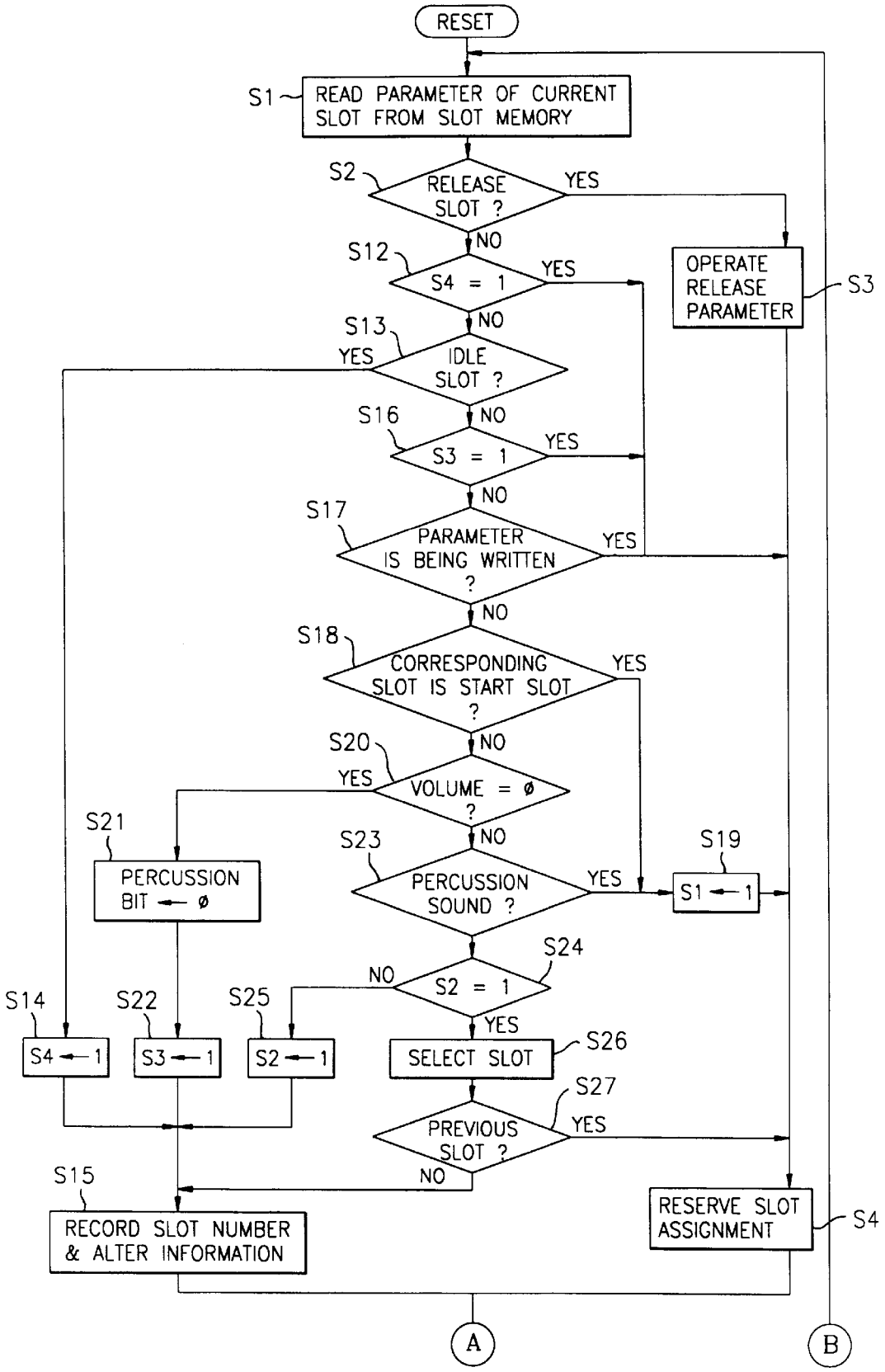
FIG. 10A and 10B are flow charts showing a control method for the digital sound generating apparatus of FIG. 5 according to the present invention.
Figure 10B:
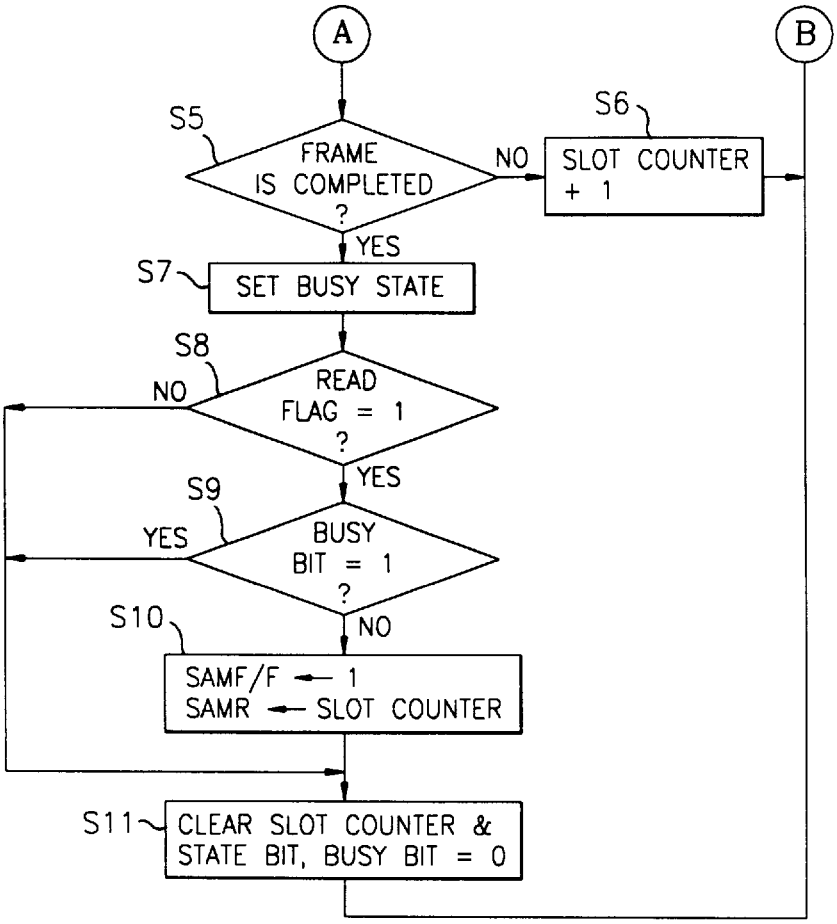

FIGS. 10A and 10B show the digital sound generating method according to the present invention. The search for a slot in the slot memory that can accommodate new sound data is performed according to the following steps.

First, before the slot search begins, all parameters are initialized. That is, the state generator 35 operates so that the state bits S1, S2, S3 and S4 of all slots are set to 0, while the slot operation mask bits SOMB0, SOMB1 of each slot are both set to 1, meaning that all slots are idle. Then, the slots are operated on depending on what sounds are to be generated. In other words, data from the slot memory 12 is written into the appropriate slots to be used to generate the desired sounds. To do so, the CPU sets the SOMB0, SOMB1 of a desired slot to 0 and 1, respectively, indicating that sound data can be written thereto.

After the data for one frame of sound stored in the slot memory 12 is written into all the desired slots, the slots are operated to generate the desired sound. Such slot processing is repeated for each frame of sound. As sound data is written into the slots and as the slots generate sound, the state bits for each slot are set accordingly. When new sound data needs to be written into a slot to generate a new desired sound, a search for the appropriate slot to receive such new data is performed. The slot assigner 100 performs this function, instead of relying exclusively on the CPU as was done in the conventional art. If the new data is to be written into a slot that is currently generating sound, the generated sound needs to be attenuated, (i.e., released at a faster rate than the rate currently being used) so that the slot is quickly made idle to accommodate new data to be written therein. Thus, at any moment of time during digital sound generation, all the slots may generate sound, may remain idle (i.e., not generate sound) or any combination thereof.

In step S1, the slot counter 51 begins counting and the first slot value is stored in the slot counter buffer 52 as well as in the slot assign register 53. The slot search is begun by checking the first slot, slot (0). The slot assign register value is also stored in the slot assign mask register SAMR 41, discussed in further detail below with respect to releasing the sound being generated from a slot needs to be released, in order to allow the writing of new data therein. The slot assigner 100 has registers, indicating the states of the current slot based on the data stored in the slot memory 12 and, which are read by the CPU. In particular, the slot assign mask flip-flop SAMF/F 42 and the state bit S4 of the state generator 35 are first read by the CPU in step S1.

In step S2, it is determined whether the sound in the current slot should be released or not, depending upon the slot assign mask flip-flop SAMF/F value. If SAMF/F=0, the slot is not released, while SAMF/F=1 means that it is released.

In step S3, the slot releasor 40 decreases the magnitude of the current sound using the release parameters and clears SAMF/F to 0. Next, in step S4, the slot assignment is reserved. In other words, the slot value in the slot counter buffer 52 is maintained therein during the release operation.

Then, the CPU determines whether the slot search should continue or not, according to steps S5 to S11. In step S5, the CPU checks to see if the slot search process for one frame has been completed or not. If not, the slot counter 51 is incremented by 1 in step S6, and the slot search for the same frame continues beginning from step S1 again.

On the other hand, if the search for one frame has been completed, the busy state bit is set in step S7. Afterwards, the read flag is checked in step S8. If the read flag is not 1, step S11 is performed whereby the slot counter 51, the state bits, and the busy bit are all cleared to zero, and the slot search process for the next frame begins from step S1. But, if the read flag is 1, the busy bit is checked in step S9.

In step S9, if the busy bit is 1, step S11 is performed as discussed above. If the busy bit is not 1, then step S10 is performed whereby the slot assign mask flip-flop SAMF/F 42 is set to 1. Also, the slot counter value is stored into the slot assign mask register SAMR 41. Then, step S11 is performed as discussed above.

In step S12, the state bit S4 for the current slot is read. The state bit S4 indicates that the current slot is idle (S4=1), processing proceeds to step S4. If S4 is not equal to 1 (S4=0), then in step S13, the CPU checks whether SOMB0=1 and SOMB1=1 for the current slot (i.e., the slot is idle, but the S4 state bit has not been set). If the current slot is idle, then in step S14 the state bit S4 is set to 1. Next in step S15, the current slot number is written in the slot assign register 53, and the current slot information in the current slot volume register CSVR 21, the current slot volume rate register CSVRR 23 and the current target volume register CSTVR 25 are transferred to previous slot volume register PSVR 22, the previous slot volume rate register PSVRR 24 and the previous slot target volume register PSTVR 26, respectively. Steps S5 to S11 are then performed as discussed above.

If the current slot is not idle, the state bit S3 therefor is checked in step S16. State bit S3 indicates whether the volume in the slot is 0 or not. The state bit S3=1 if the current slot has volume=0. Then, the value in slot counter buffer 52 is maintained in step S4, and steps S5 to S11 are performed.

If S3 does not equal 1 in step S16, then in step S17, the CPU checks whether a data parameter is being written into the current slot. If so, the slot number is maintained in the slot counter buffer 52 in step S4, and steps S5 to S11 are performed. If data parameters are not being written, step S18 is performed.

In step S18, the CPU checks if the current slot is a start slot, that is if the current slot is slot (0). If so, state bit S1 is set to 1 in step S19, the slot number is maintained in the slot counter buffer 52 in step S4, and steps S5 to S11 are performed. If not, the slot search continues.

In step S20, it is checked whether the volume of the current slot is 0 or not. If the volume=0, the percussion bit is set to 0 in step S21, the state bit S3 is set to 1 in step S22, and the current slot number stored in the slot counter buffer 52 is passed to the slot assign register 53 in step S15. Also, the current slot information in registers CSVR 21, CSVRR 23 and CSTVR 25 are transferred to the previous slot registers PSVR 22, PSVRR 24 and PSTVR 26, respectively. Accordingly, this slot number will later be read by the CPU for writing new data into the slot. Then, steps S5 to S11 are performed. If the volume is not 0, the step S23 is performed.

In step S23, the CPU checks whether the current slot has a percussion sound therein. In particular, the percussion sound bit (PSB) in the register 33, which indicates that the slot has a percussion sound, is checked. Also, the percussion sound mask bit (PMB) in the register 32 is checked to see if the slot should be treated as not having a percussion sound regardless of whether a percussion sound is actually present in the slot.

If the CPU finds that the current slot has a percussion sound, step S19 is performed whereby the state bit S1 is set to 1 and the slot number is maintained in the slot counter buffer 52 in step S4, and steps S5 to S11 are then performed. If the current slot does not have a percussion sound, the state bit S2 is checked in step S24.

In step S24, if the CPU finds that S2 is not 1, the state bit S2 is set to 1 in step S25, step S15 is performed as described above. Then, steps S5 to S11 are performed. If S2 is 1, the CPU determines whether the current or the previous slot is to be selected in step S26.

In step S26, the slot volume, the slot volume rate, and the slot target volume of the current slot and those of the previous slot are compared to determine which slot is to be selected. A slot volume comparator 60 including a first, second and third comparators 63, 64, 65 is used to determine which slot (i.e. the current slot or the previous slot) should be selected. A slot decision logic circuit SDL 66 operates to store the previous or current slot number into the slot counter buffer 52.

In step S27, if the previous slot is selected, the slot number is maintained in the slot counter buffer 52 in step S4, and steps S5 to S11 are performed. If not, that is, if the current slot is to be selected, the current slot number stored in the slot counter buffer 52 is passed to the slot assign register 53. Then steps S5 to S11 are performed.

As described above, the present invention allows proper slot allocation using a slot assigner in order to relieve the burden of the CPU during digital sound processing. Although several preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A digital sound generating apparatus, comprising:

an interface interfacing with a processing unit; and a slot memory having a plurality of slots, each slot for storing sound data for a sound, and said slot memory receiving said sound data from said interface; and a slot assigner identifying a slot state of a slot based on said sound data stored in said slot memory, and outputting said slot state to said interface, said slot state indicating an availability of said slot to store new sound data for a new sound.

2. The digital sound generating apparatus of claim 1, further comprising:

a data processor for processing said sound data stored in said slot memory; and a sound generator generating sounds based on said processed sound data.

3. The digital sound generating apparatus of claim 1, wherein said slot assigner identifies whether said slot is idle.

4. The digital sound generating apparatus of claim 1, wherein said slot assigner identifies whether said slot stores sound data for a sound having a volume of zero.

5. The digital sound generating apparatus of claim 1, wherein said slot assigner identifies whether said slot stores sound data for a sound having a percussion sound.

6. The digital sound generating apparatus of claim 1, wherein said slot assigner compares volume data of a current slot with volume data of a previous slot, and identifies, based on said comparison, one of said current slot and said previous slot as being available to store said new sound data.

7. The digital sound generating apparatus of claim 1, wherein said slot assigner identifies whether said slot is idle; if said slot assigner does not identify said slot as idle, said slot assigner identifies whether said slot stores sound data for a sound having a volume of zero, ; if said slot assigner does not identify said slot as a zero volume slot, said slot assigner identifies whether said slot stores sound data for a sound having a percussion sound; and if said slot assigner does not identify said slot as a percussion sound slot, said slot assigner compares volume data of a current slot with volume data of a previous slot, and determines, based on said comparison, one of said current slot and said previous slot as being available to store said new sound data.

8. A digital sound generating method, comprising:

identifying, using a slot assigner, slot states of a plurality of slots in a slot memory, said slot state indicating an availability of an associated slot to store new sound data for a new sound;

determining in which of said plurality of slots to store said new sound data based on said slot states; and storing new sound data received from a processing unit in said determined slot.

9. The digital sound generating method of claim 8, further comprising:

processing, using a data processor, said sound data stored in said slot memory; and generating, using a sound generator, sounds based on said processed sound data.

10. The digital sound generating method of claim 8, wherein said identifying step identifies an idle slot from said plurality of slots; and said determining step determines said identified idle slot as said determined slot.

11. The digital sound generating method of claim 8, wherein said identifying step identifies a zero volume slots, which is a slot from said plurality of slots storing sound data for a sound having a volume of zero; and said determining step determines said identified zero volume slot as said determined slot.

12. The digital sound generating method of claim 8, wherein said identifying step identifies a percussion sound slot, which is a slot from said plurality of slots storing sound data for a sound having a percussion sound; and said determining step determines said identified percussion sound slot as said determined slot.

13. The digital sound generating method of claim 8, wherein said identifying step compares volume data of a current slot with volume data of a previous slot, and identifies one of said current slot and said previous slot as being available to store said new sound data; and said determining step determines said identified slot as said determined slot.

14. The digital sound generating method of claim 8, wherein said identifying step includes, first identifying an idle slot of said plurality of slots;

second identifying a zero volume slot which is a slot from said plurality of slots storing sound data for a sound having a volume of zero, if said first identifying step does not identify an idle slot;

third identifying a percussion sound slot which is a slot from said plurality of slots storing sound data for a sound having a percussion sound, if said second identifying step does not identify a zero volume slot;

comparing volume data of a current slot with volume data of a previous slot, if said third identifying step does not identify a percussion sound slot; and fourth identifying one of said current slot and said previous slot as being available to store said new data based on said comparison.

* * * * *